United States Patent [19]

Geller et al.

[11] 4,059,464

[45] Nov. 22, 1977

[54] METHOD OF MAKING FOLD-OUT ZIPPER BAG

[75] Inventors: Thomas L. Geller, Colts Neck; Harold Rabinowitz, Lakewood, both of N.J.

[73] Assignee: Dart Industries Inc., Los Angeles, Calif.

[21] Appl. No.: 724,444

[22] Filed: Sept. 20, 1976

Related U.S. Application Data

[62] Division of Ser. No. 625,980, Oct. 28, 1975, Pat. No. 3,994,372.

[51] Int. Cl.[2] ..... B32B 1/10; A45C 7/00; B32B 31/20

[52] U.S. Cl. ..... 156/66; 156/92; 156/93; 156/182; 156/297; 156/300; 224/47; 312/244

[58] Field of Search ..... 156/182, 66, 91, 92, 156/93, 297, 300, 222, 223, 221; 190/41 Z, 43, 53; 150/52 E, DIG. 1; 224/8 R, 26 R, 43, 44, 47; 312/244, DIG. 33

[56] References Cited

U.S. PATENT DOCUMENTS

| | | | |
|---|---|---|---|
| 2,005,791 | 6/1935 | Kruse | 190/41 Z UX |
| 2,254,578 | 9/1941 | O'Brien | 190/43 |
| 3,173,465 | 3/1965 | Pastini | 190/43 X |
| 3,295,643 | 1/1967 | Peterson et al. | 190/53 X |
| 3,637,000 | 1/1972 | Walger et al. | 190/53 X |
| 3,708,045 | 1/1973 | Katz | 190/41 Z |
| 3,777,862 | 12/1973 | Zipper | 190/41 Z |

*Primary Examiner*—William A. Powell
*Assistant Examiner*—Thomas Bokan
*Attorney, Agent, or Firm*—Kenneth J. Hovet

[57] ABSTRACT

A three-piece tote bag and method of construction is described. The bag includes two end panels which are assembled to a body panel with zippers. The periphery of the end panels are provided with zipper halves which engage cooperating zipper halves along the side edges of the body panel to form the bag. Each of the three panels are produced in a flat condition and contain stiffening means and insulative material between outer cover and inner liner sheets. The panels are sealed about their peripheral edges and the zipper halves are stitched to the panel edges.

5 Claims, 9 Drawing Figures

METHOD OF MAKING FOLD-OUT ZIPPER BAG

This is a division of application Ser. No. 625,980, filed Oct. 28, 1975, now U.S. Pat. No. 3,994,372.

BACKGROUND OF THE INVENTION

1. Field of the Invention

The present invention relates to a tote bag and, more particularly, to a three-piece fold-out zipper bag.

It is desirable to produce a traveling bag that sufficiently protects its contents, yet can be collapsed into a compact shape for storage. The bag must be durable and provide a light-weight means for carrying various articles while providing the largest volume possible.

U.S. Pat. No. 2,254,578 describes a zipper duffle bag which, when unzipped, assumes a flat posture for subsequent folding into a compact shape. The disadvantage of this bag is that it is entirely unitary which renders it cumbersome for storage and unwieldly during its manufacture. Additionally, at each corner of the bag there is a zipper which is thereby subjected to possible scarfing or damage with the subsequent problem of opening the bag.

A similar type bag is shown in U.S. Pat. No. 3,777,862. This bag again discloses a unitary structure which as forementioned creates substantial problems in manufacture. Additionally, the patented bag requires the use of zippers about the entire periphery of the bag. This, of course, has the disadvantage in preventing access to the bag if a zipper misalignment would occur. Additionally, if one of the flaps would become damaged, the user would have to replace the entire bag.

SUMMARY OF THE INVENTION

The present invention provides a method of making a fold-out zipper bag which may be opened or closed with a strap means without the disadvantage of a zipper fastener throughout. The bag includes three pieces comprising two end panels and a large somewhat rectangular-shaped body panel. The periphery of each of the end panels is provided with a zipper half which mates with a corresponding zipper half along the side edges of the body panel. The end panels are engaged with the side zippers on the body panel and as the matching zippers are closed the bag is formed with the body portion forming the outline of the end panels. A strap is included across the top end for fully enclosing the bag and pouches may be secured to the inner liner thereof for storage of articles or the like.

Each of the panels includes stiffening members and insulative matting juxtaposed between an inner liner and outer liner cover. The body panel may be folded out partially without complete unzipping to allow access to the bag interior.

DESCRIPTION OF A PREFERRED EMBODIMENT

The overall zipper bag assembly of the present invention includes a body panel 14 and two end panels 20. Each of the end panels are generally rigid and flat and are preferably identical in shape. They have a generally trapezoidal outline, although other configurations would work equally well and are simply a matter of design choice.

The body panel 14 is generally flat and rectangular in outline and is foldable along transverse creases (not shown) extending across the panel between side edges 16 and 18. The creases occur at locations between corresponding corners of the opposing end panels when the body panel is folded thereabout. It will be understood that the length of the body panel 14 is about at least equal to the circumference of an end panel so that a fully enclosed bag may be formed. Of course, the distance the end panels are spaced apart is dictated by the width of the body panel.

Figure 1:
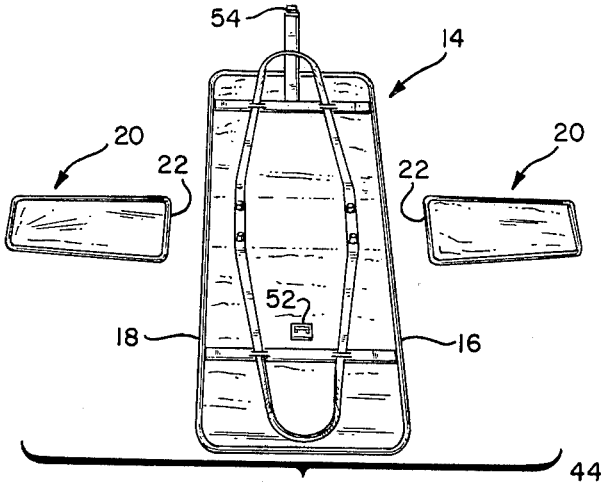
FIG. 1 is a perspective view of the exterior surfaces of the fold-out zipper bag of the present invention disassembled.
Figure 2:
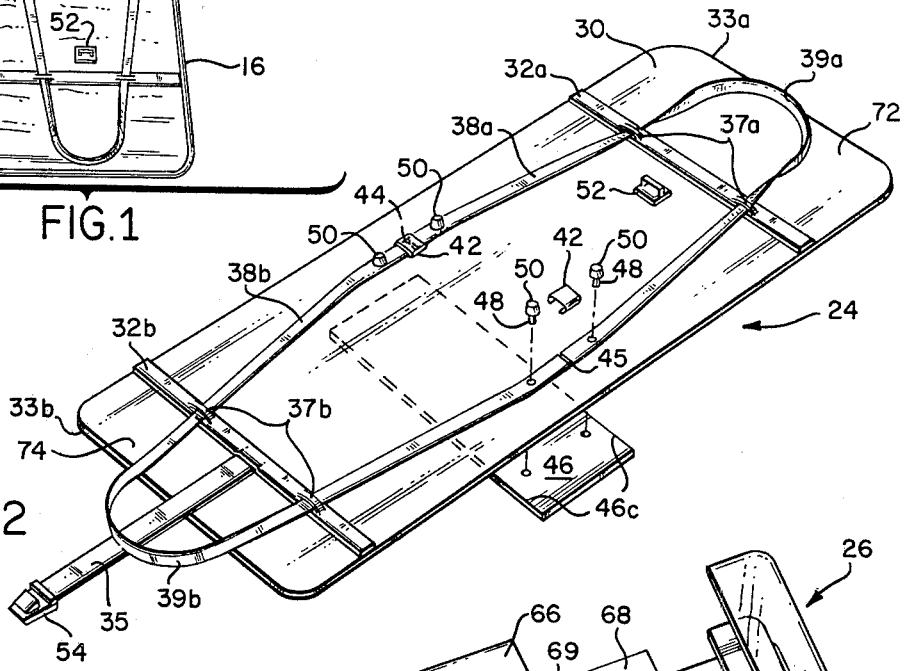
FIG. 2 is an exploded perspective view showing the cover subassembly.

The body panel 14 is constructed of a cover subassembly 24 which is sealed and/or stitched to a liner subassembly 26. As best shown in FIG. 2, the cover subassembly includes a pre-cut cover sheet 30 of thermoplastic material having the aforementioned side edges 16, 18 and opposing ends 33 *a,b*. The cover sheet is provided with transverse strips 32 *a* and *b* extending between edges 16, 18 proximate the opposing ends 33 *a,b*. The strips preferably extend across the width of the sheet and are secured thereto by stitching or with the use of an appropriate adhesive. Each strip is provided with two pairs of slits 37 *a,b* spaced apart along the length thereof for a purpose to be discussed hereinafter.

Attached to the cover subassembly 24 are strap handles 38 *a,b*. Each strap is of sufficient length to extend through respective slits 37 *a,b* and form loops 39 *a* and *b* proximate respective cover sheet ends 33 *a,b*. The corresponding terminal ends of each strap abut at points 44 and 45 at about the cover sheet midpoint. The terminal ends of each strap are secured to the cover sheet with stitching and are preferably covered with patches 42.

A base board 46 is located and centered about midpoint of the cover sheet length beneath the abutment points 44 and 45. The base board has a width about equal to the cover sheet width and forms the bottom support for the assembled bag. Rivets 48 are passed through the straps 38 *a,b* and cover 30 and are securely fastened to the base board 46. Preferably, the rivets include cushion stubs 50 which operate as bottom pedestals for the final zipper bag assembly and function to protect the cover from soiling and abrasion.

Figure 9:
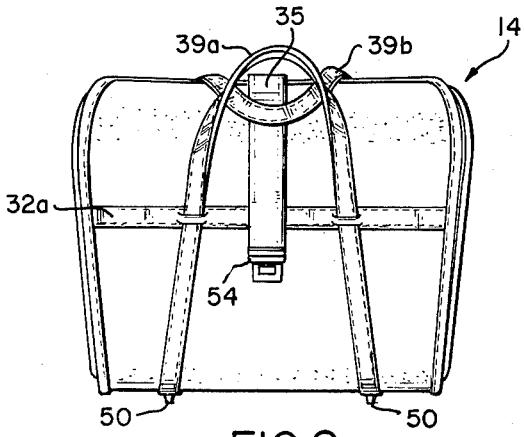
FIG. 9 is a perspective view of the front of the assembled and closed bag of FIG. 1.

The cover 30 preferably includes a clasp 52 which may be clamped and/or secured thereto by an adhesive, stitching or the like. Cooperating with the clasp is connector 54 attached to the end of strap 35. As shown in FIG. 9, the connector engages the clasp in a known manner and functions to close the bag by causing end 33*b* to overlap end 33*a*. It will be appreciated that strap 35 is conveniently attached to cover 30 with stitching or the like simultaneous with the attachment of strip 32*b*.

Figure 3:
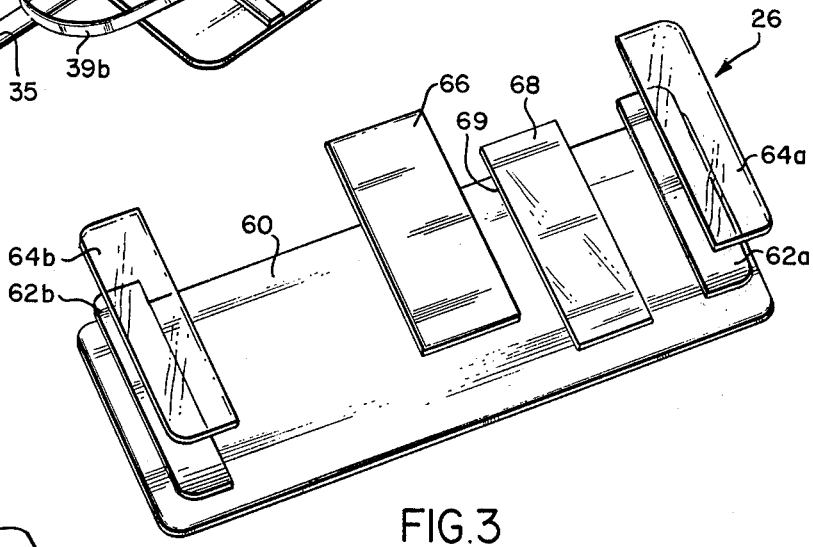
FIG. 3 is an exploded perspective view of the liner subassembly.
Figure 4:
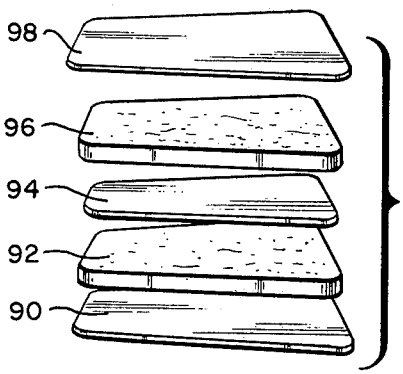
FIG. 4 is a perspective exploded view of an end panel assembly.

Referring now to FIG. 3, the construction of liner subassembly 26 will be described. A thin sheet 60 of die-cut thermoplastic material is placed on a flat surface. Stiffening members 62 *a* and *b* are placed adjacent opposite ends thereof. The stiffening members are covered with corresponding thermoplastic sheet materials 64 *a* and *b*. An additional base liner sheet 66 is placed about at the midpoint of the length of sheet 60. The location of this sheet corresponds to the location of base board 46 and serves as a reinforcement to liner sheet 60 at the bottom of the assembled bag.

With each of the preformed sheets and stiffening members in place, an appropriate heat sealing frame is placed thereover and the subassembly is consolidated with heat seal bonding about the peripheral edges of sheets 60, 64 *a,b* and 66. It will be understood that peripheral bonding of sheets 64 *a,b* will enclose and seal-in the stiffening members 62 *a,b*.

In a preferred embodiment, one may optionally include an additional sheet of material 68 to function as a liner pocket. In such a case, the thermoplastic sheet material is heat-sealed along opposing peripheral edges and across the transverse bottom edge 69 adjacent the base insert 66. This can occur simultaneous with the sealing of sheets 64 *a,b* and 66. In this manner an open pocket is formed on the interior of the bag for storage of miscellaneous items.

The body panel 14 is formed by placing the cover subassembly 24 over a layer of insulative material 70 which overlies the liner subassembly 26. The three layers are coextensive and are preliminarily consolidated by peripheral heat sealing by means well-known in the art. Prior to the sealing step it has been found desirable to position zippers 80 and 82 along each edge 16 and 18, respectively. The length of each zipper is less than the body panel length whereby the end of each zipper terminates at corresponding points which are offset about equally a predetermined distance away from ends 33 *a,b*. The purpose of such shortened zippers is to create flaps 72, 74 about the unzipped end portion adjacent edges 33*a* and 33*b*, respectively.

It will be appreciated that entire zippers consisting of two engaged rows of opposing teeth with two corresponding strips of tape with a sliding closure piece are used along each body panel edge. The tape corresponding to one row of teeth is superimposed along the edges 16, 18 of liner sheet 60 and bonded thereto simultaneous with the aformentioned preliminary consolidation step. Subsequently, the zippers 80 and 82 may be disengaged leaving one-half of each zipper 80*a* and 82*a* bonded to the body panel edges. The disengaged zipper halves 80*b* and 82*b* are secured to the appropriate end panel during the construction thereof.

After the preliminary consolidation step, the body panel is transported to a stitching station wherein a border stripping 78 is placed over the unfinished panel edges in a U-shaped fashion and stitched thereto. The stitching thread 84 passes through both sides of the stripping 78, the zipper tape 80*a* and the panel sheets 30 and 60.

Figure 5:
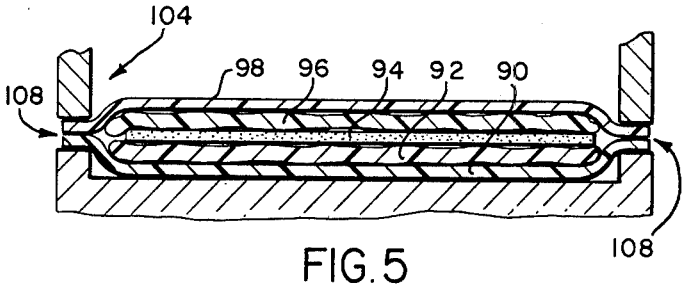
FIG. 5 is a fragmentary elevation sectional view showing the heat sealing of the edges of the end panel.
Figure 6:
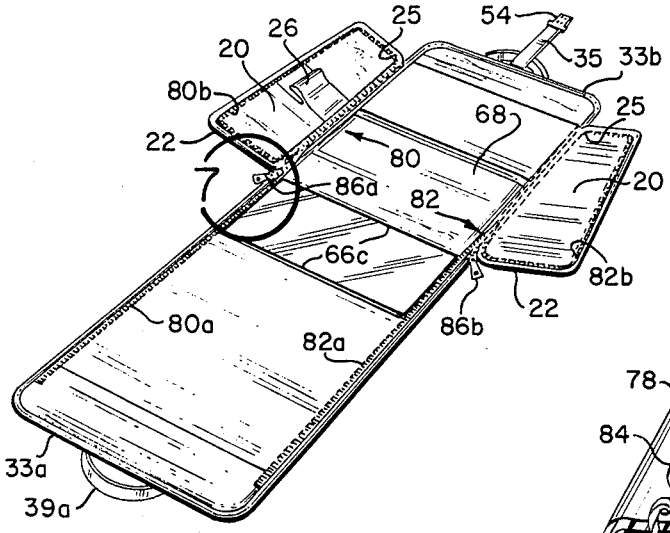
FIG. 6 is a perspective of the interior of the bag of FIG. 1 with the end panels zipped to the edges of the body panel.
Figure 7:
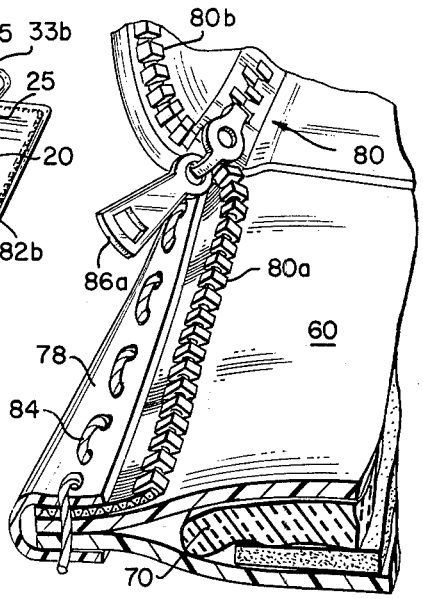
FIG. 7 is a fragmentary sectional view taken along line 7 of FIG. 6.
Figure 8:
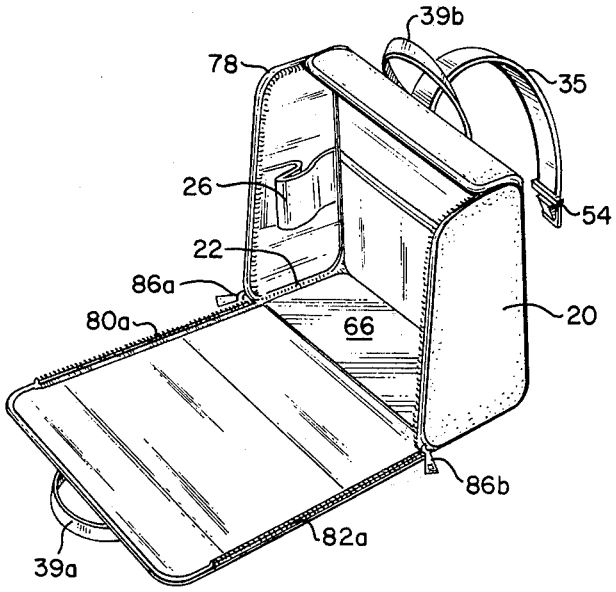
FIG. 8 is a perspective view of the bag of FIG. 1 partially open.

In a similar fashion, end panels 20 are produced by assembling an inner liner 90 having superimposed thereon an insulative matting 92, a stiffening insert 94, another insulative matting 96 and an outer thermoplastic cover 98. Preferably, zipper halves 80*b* and 82*b* are located about the periphery 108 of each end panel assembly. The assembly is consolidated about its peripheral edges by localized high-frequency heating means 104 schematically shown in FIG. 5. Each end panel thus formed is provided with one of the zipper halves 80*b* and 82*b*.

A zipper half is preferably stitched about substantially the entire periphery of each panel 20 beginning and ending near a corner at point 25. Border stripping 78 is placed about the edges 108 of each panel and stitched thereto simultaneous with the zipper halves in a manner similar to that described with the body panel.

It will be appreciated that point 25 of each end panel will coincide with the end of zipper halves 80*a* and 82*a* near end 33*b* of the body panel. The end panels are positioned adjacent the panel edges 16, 18 and sliding closure members 86 *a* and *b* will engage each respective cooperating zipper half at points 25. In this way each end panel may be fastened to the sides 16, 18 of the body panel.

Note that the length of each panel is about equal to the distance from the ends of each zipper half 80*a* and 82*a* to a point adjacent the coextensive lateral edges 66*c* and 46*c* of liner sheet 66 and base board 46, respectively. Additionally, the width of the liner sheet and base board is about equal to at least the bottom ends 22 of the end panels 20. Of course, with the above relative dimensions, one may engage cooperating zipper halves of zippers 80, 82 at points 25 with closure members 86 *a,b*. As the closure members are moved about the periphery of each panel, the body panel will form transverse fold lines coextensive with the aforementioned edges 46*c* and 66*c* and form an enclosed bag having an outline corresponding to the outline of the end panels. To secure the unzipped flaps 72, 74 and completely enclose the bag, strap 35 is passed beneath loops 39 *a,b* and engaged with clasp 52.

It will be appreciated that the end panels 20 optionally include a pocket 26 which is simply a preformed plastic sheet extending across the liner 90 and sealed in the same manner as pocket 68. Additionally, with the present invention it will be appreciated that each member of the zipper bag is produced on a planar surface without requiring three-dimensional stitching, of cumbersome molds or heat sealing means to consolidate each of the separate parts. Of course, the above gives the further advantage of allowing the bag to be separated into three flat pieces for convenient storage requiring a minimum of space. Each of the different parts may be replaced when worn without requiring a consumer to purchase an entire new bag.

A further advantage of the present invention will be noted in that the entire interior of the bag is void of any metallic or other type of hardware surface which may cause scratches. Note also that the exterior of the zipper bag is provided with substantially no hardware other than the latch and hardware assembly 52 and 54. Again this has the advantage of economy in construction with fewer parts to be snagged, tarnished or worn-out.

While the invention has been described with respect to a preferred embodiment, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

We claim:

1. A method of making a zipper bag including the steps of:

A. producing a cover subassembly comprising:

1. providing a generally rectangular cover sheet of thermoplastic material;

2. securing a rigid base board to the middle of said cover sheet;

B. producing a liner subassembly comprising:

1. providing a liner sheet of thermoplastic material;

2. securing rigid inserts adjacent the ends of said liner sheet;

C. producing a body panel by superimposing said liner subassembly with said cover subassembly on a flat surface and bonding together the edges of said liner subassembly and said cover subassembly;

D. securing one-half of two zipper means along each longitudinal edge of said body panel;

E. producing two end panels by consolidating two multi-layer assemblies each comprising a rigid insert between a cover sheet and a liner sheet and bonding the edges of said sheets together;

F. securing a corresponding half of each of said two zipper means about the circumference of each of said end panels; and, G. connecting each of said end panels to the edges of said body panel by fastening together each of the corresponding zipper halves.

2. The method of claim 1 including the step of interposing an insulative layer of material between said liner subassembly and said cover subassembly prior to carrying out the subassembly bonding step of step C.

3. The method of claim 1 wherein steps C and D are carried out simultaneously and steps E and F are carried out simultaneously.

4. The method of claim 3 including the step of overlaying said rigid inserts in step B.2 with a thermoplastic covering and bonding said covering to said liner sheet.

5. The method of claim 4 including the step of attaching a transverse strip near each end of said cover sheet with each strip having a pair of slits therein; inserting elongated straps through said slits and forming loops with said straps adjacent said cover sheet ends; and, securing said straps to said cover sheet.

* * * * *